US007832662B2

(12) United States Patent
Gallo

(10) Patent No.: US 7,832,662 B2
(45) Date of Patent: Nov. 16, 2010

(54) SHOWER HEAD

(75) Inventor: Dina Gallo, Stuttgart (DE)

(73) Assignee: Hansa Metallwerke AG, Stuttgart (DE)

( * ) Notice: Subject to any disclaimer, the term of this patent is extended or adjusted under 35 U.S.C. 154(b) by 347 days.

(21) Appl. No.: 11/997,945

(22) PCT Filed: Aug. 3, 2006

(86) PCT No.: PCT/EP2006/007669

§ 371 (c)(1),
(2), (4) Date: Feb. 5, 2008

(87) PCT Pub. No.: WO2007/025625

PCT Pub. Date: Mar. 8, 2007

(65) Prior Publication Data

US 2008/0203197 A1 Aug. 28, 2008

(30) Foreign Application Priority Data

Aug. 30, 2005 (DE) ..... 10 2005 041 143

(51) Int. Cl.
*B05B 15/08* (2006.01)

(52) U.S. Cl. ..... 239/587.1; 239/193; 239/393; 239/447; 239/587.5; 239/579

(58) Field of Classification Search ..... 239/193, 239/446, 447, 393, 587.1, 587.5, 579
See application file for complete search history.

(56) References Cited

U.S. PATENT DOCUMENTS 6,550,697 B2 * 4/2003 Lai ..... 239/446
7,455,247 B2 * 11/2008 Kajuch ..... 239/451
7,594,617 B2 * 9/2009 Kaess et al. ..... 239/579
2002/0074430 A1 6/2002 Gransow et al.

FOREIGN PATENT DOCUMENTS

| | | | |
|---|---|---|---|
| DE | 86 26 622 | U1 | 11/1986 |
| DE | 100 63 956 | A1 | 7/2002 |
| DE | 102 61 267 | B3 | 5/2004 |
| DE | 102 19 943 | B4 | 1/2005 |
| EP | 1359260 | A2 | 11/2003 |
| WO | 0012221 | A1 | 3/2000 |
| WO | 2006094684 | A1 | 9/2006 |

* cited by examiner

*Primary Examiner*—Dinh Q Nguyen
(74) *Attorney, Agent, or Firm*—Factor & Lake, Ltd.

(57) ABSTRACT

Disclosed is a shower head comprising a housing-type first part (T1) inside which a water duct extends. One end of said water duct communicates with a water inlet. The first part (T1) is connected to a second part (T2) that is embodied as a discharging element. The receiving space of the discharging element communicates with the other end of the water duct in at least one mode of operation of the shower head. In said mode of operation, the external edge of the second part (T2) forms an overflow edge in one region, via which water can flow off. The second part (T2) forming the discharging element is composed of a top portion and a bottom portion, between which an interior space is located that communicates with the second end of the water duct in a second mode of operation of the shower head. A plurality of nozzle-type discharge ports (A2) are arranged in the bottom portion of the second part (T2). The inventive shower head is inexpensive to produce while being able to alternatively or cumulatively generate a water curtain discharged via the overflow edge and/or a plurality of individual shower jets discharged through the nozzle-type discharge ports (A2).

8 Claims, 6 Drawing Sheets

SHOWER HEAD

RELATED APPLICATIONS

This application claims the filing benefit of International Patent Application No. PCT/EP2006/007669, filed Aug. 3, 2006, which claims the filing benefit of Germany Patent Application No. 10 2005 041 143.6 filed Aug. 30, 2005, the contents of which are incorporated herein by reference.

TECHNICAL FIELD

The invention relates to a shower head for a shower having a) a housing-like first part, in which runs a water-guiding channel which communicates, at a first end, with a water inflow opening;

b) a second part, which is connected to the first part and is formed as an outflow element, the receiving space of which communicates with a second end of the water-guiding channel in at least one mode of operation of the shower head, and the outer border of which, in this mode of operation, forms in one region an overflow edge via which water can flow off;

c) the second part additionally having a plurality of nozzle-like outlet openings which communicate with the second end of the water-guiding channel at least in a second mode of operation of the shower head and via which a corresponding plurality of shower jets can then emerge.

BACKGROUND OF THE PRESENT INVENTION

Recently, shower heads in which, at least in one mode of operation, the water does not emerge in a large number of individual jets but rather it is possible to produce a kind of "water curtain" which flows over an outflow edge of an inclined, upwardly open outflow element, e.g. a curved outflow dish, have gained considerable popularity. Shower heads of this type not only have an unusual, striking aesthetic appearance; what is more, the outflow element has a technical function: this consists in that the water emerging from the housing-like first part is initially caused to spread over a relatively large area and then flow off in free fall such that the desired, substantially closed water curtain is obtained. This simulates in a way a small waterfall, giving rise to a feeling of particular well-being in many users.

A shower head of the type mentioned at the outset is known from DE 102 19 943 B4. The latter describes two types of embodiment for arranging the nozzle-like outlet openings. In the exemplary embodiments illustrated in FIGS. 1 and 2, the nozzle-like outlet openings are situated in a region of the lateral surface of the housing-like first part, and in the exemplary embodiment illustrated in FIG. 3 they are situated in a through-flow body which penetrates through the outflow dish and has a considerably smaller diameter than this outflow dish. In all these exemplary embodiments, the area over which the plurality of nozzle-like outlet openings is distributed is relatively small. Moreover, the production of these known shower heads is relatively complicated.

The present invention is directed to addressing these and other matters.

SUMMARY OF THE INVENTION

An object of the present invention is to design a shower head of the type mentioned at the outset such that the production is simplified and the for form is favourable.

This object may be achieved according to the invention in that d) the second part, forming the outflow element, is formed from an upper part and a lower part, between which at least one interior space is situated, which communicates with the second end of the water-guiding channel in the second mode of operation of the shower head;

e) the nozzle-like outlet openings being arranged in the lower part.

In the design of the shower head according to the invention, the outflow element is therefore made as it were "double-walled" and the resulting interior space is utilised as a water-distributing space, via which the water can spread out over a large area and thus reach a large number of nozzle-like outlet openings distributed over a large area. These outlet openings are situated on that side of the outflow element which is opposite the side via which the water flows off as a "water curtain" in the first mode of operation.

The described design according to the invention can be easily modified in that the interior space of the second part between upper part and lower part is subdivided by at least one partition wall into at least two partial spaces which can be supplied with water independently of one another. In this way, different jet forms can be produced, since the water can be led in each case through different groups of nozzle-like outlet openings which are each associated with one of the partial spaces capable of being supplied independently.

Expediently, the nozzle-like outlet openings are formed in an elastic insert which is arranged on the inner side of the lower part. As a result, the risk of furring of the nozzle-like outlet openings is reduced.

A particularly favourable option for effecting the switching between different modes of operation of the nozzle head consists in that the second part is adjustable between at least two positions relative to the first part, each of these positions being associated with one mode of operation of the shower head.

These and other objects and advantages will be made apparent from the following brief description of the drawings and the detailed description of the invention.

DETAILED DESCRIPTION OF THE PRESENT INVENTION

Figure 1:
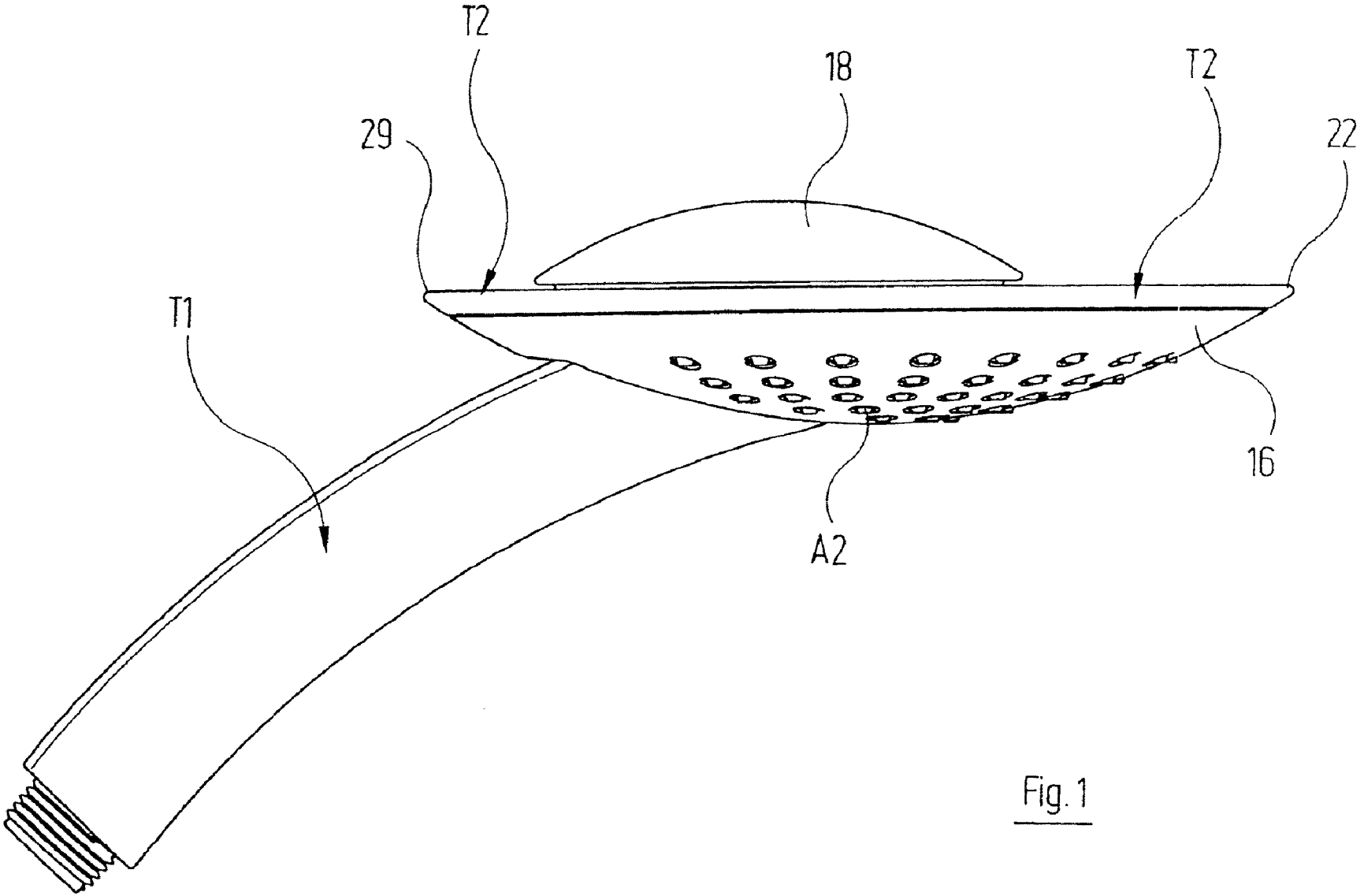
FIG. 1 shows the side view of a shower head.
Figure 2:
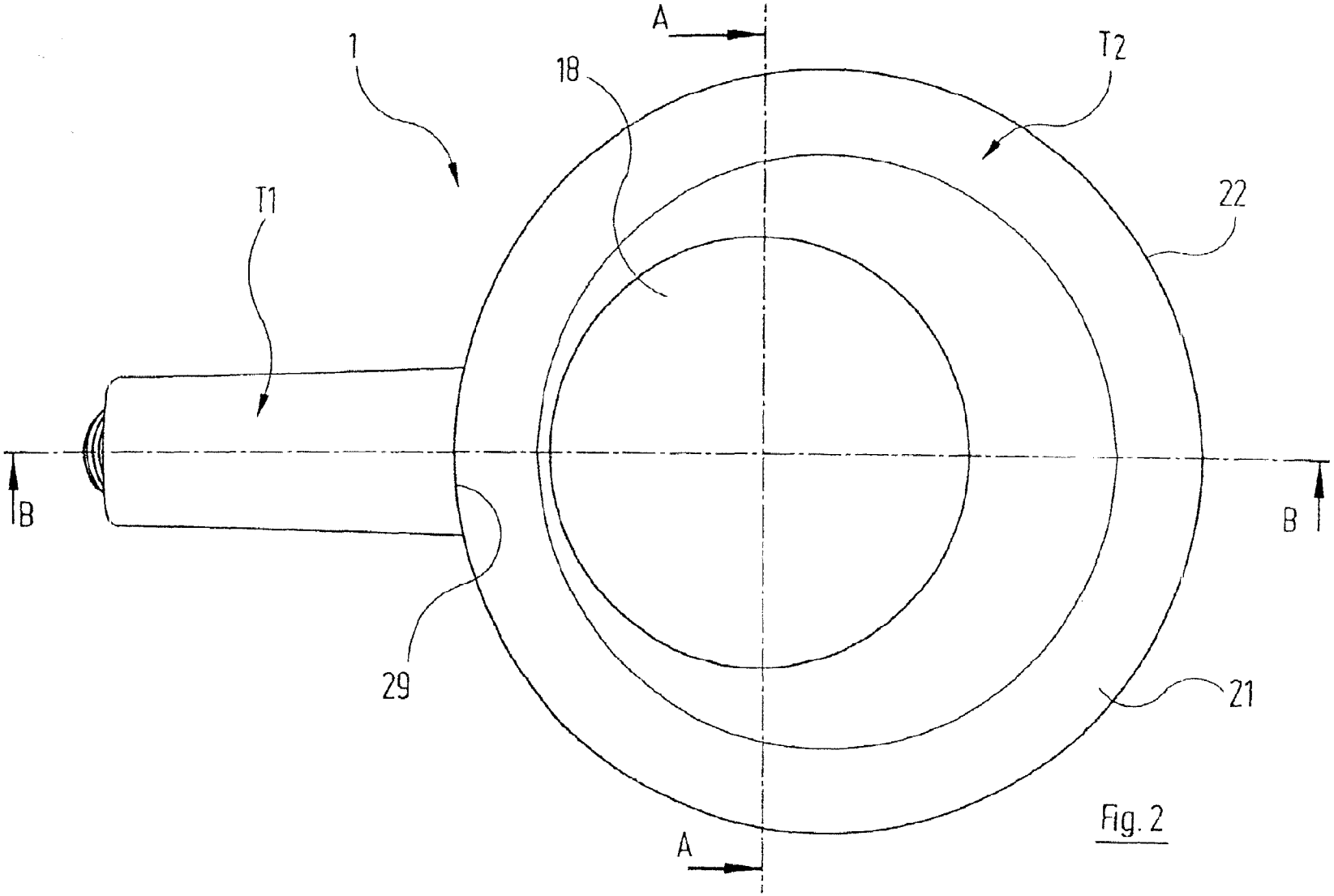
FIG. 2 shows the top view of the shower head of FIG. 1.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The shower head 1 illustrated in the drawing is intended for a shower and has a first part T1 and a second part T2. As can be seen in particular from FIGS. 3 and 4, the first part T1 comprises in a tubular housing 4 a water-guiding pipe 3, which forms a water-guiding channel 2. The water-guiding pipe 3 has at one end a water inflow opening which is surrounded by a thread 5 and to which a water conduit (not shown here), for example a flexible tube, is to be connected. The water is supplied to the second part T2, in a manner described in more detail hereinbelow, via a switching valve V.

The second part T2 is an outflow element and comprises an outflow dish 21, concavely curved when seen from above, the precise construction of which is explained hereinbelow and which has a plurality of outlet openings A2 at its underside. These openings are of nozzle-like design and can each form a shower jet in a known manner.

The second part T2 is composed of an upper part 15 and a lower part 16 which are each simple dishes, likewise concavely curved when seen from above, having a common centre of curvature. The upper part 15 and lower part 16 are connected to one another at their outer borders such that between them a closed interior space 14 is formed, with which the outlet openings A2 communicate. In this interior space 14, an insert 17 in which the discharge openings A2 are formed, is laid on the lower part 16. The insert 17 consists of rubber-elastic material.

The dish-shaped upper part 15 has an overflow edge 22 at a region of its radially outer border lying on the right in FIG. 1.

Figure 3:
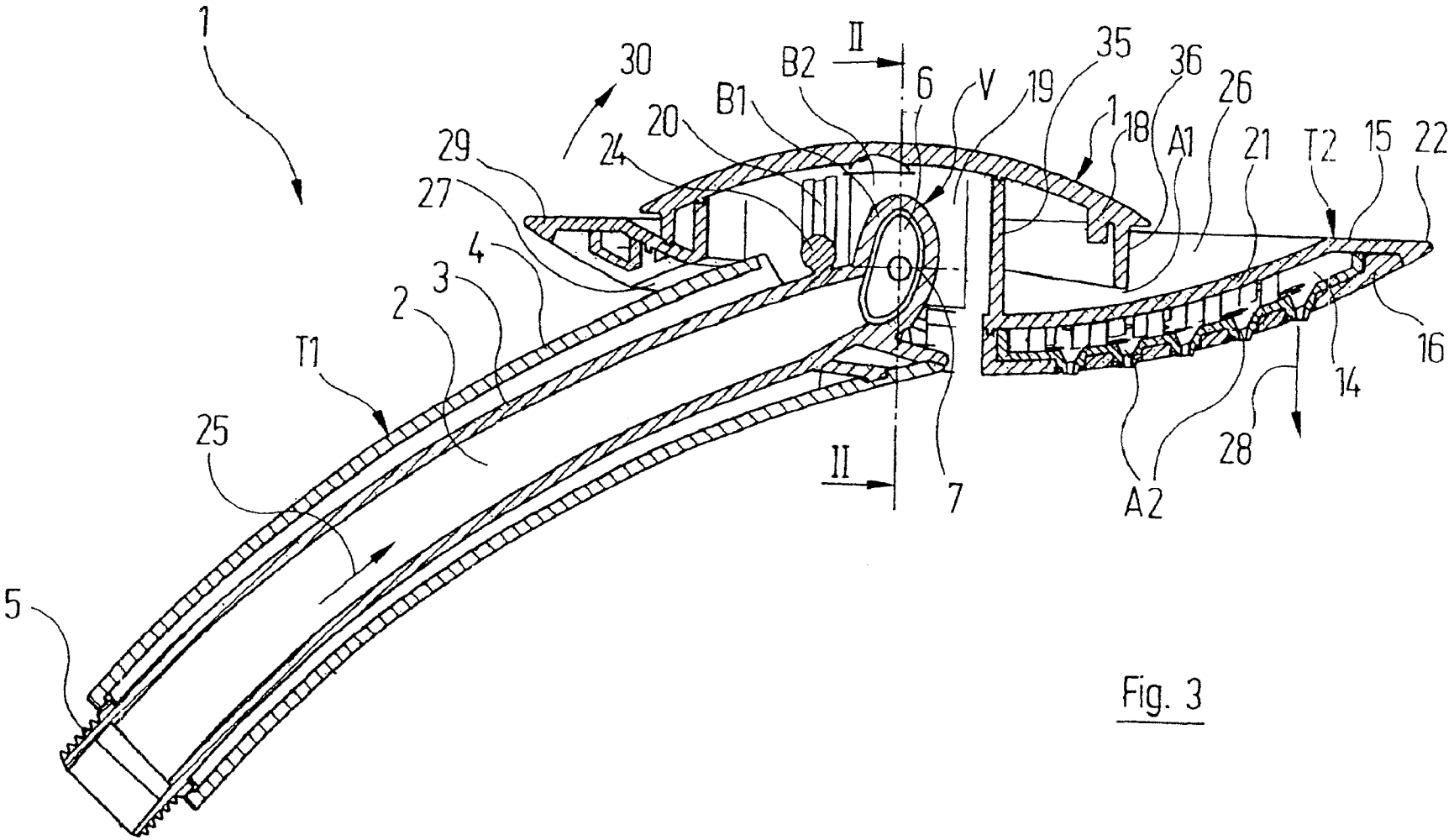
FIG. 3 shows a section along the line B-B of FIG. 2 in a first mode of operation of the shower head.
Figure 4:
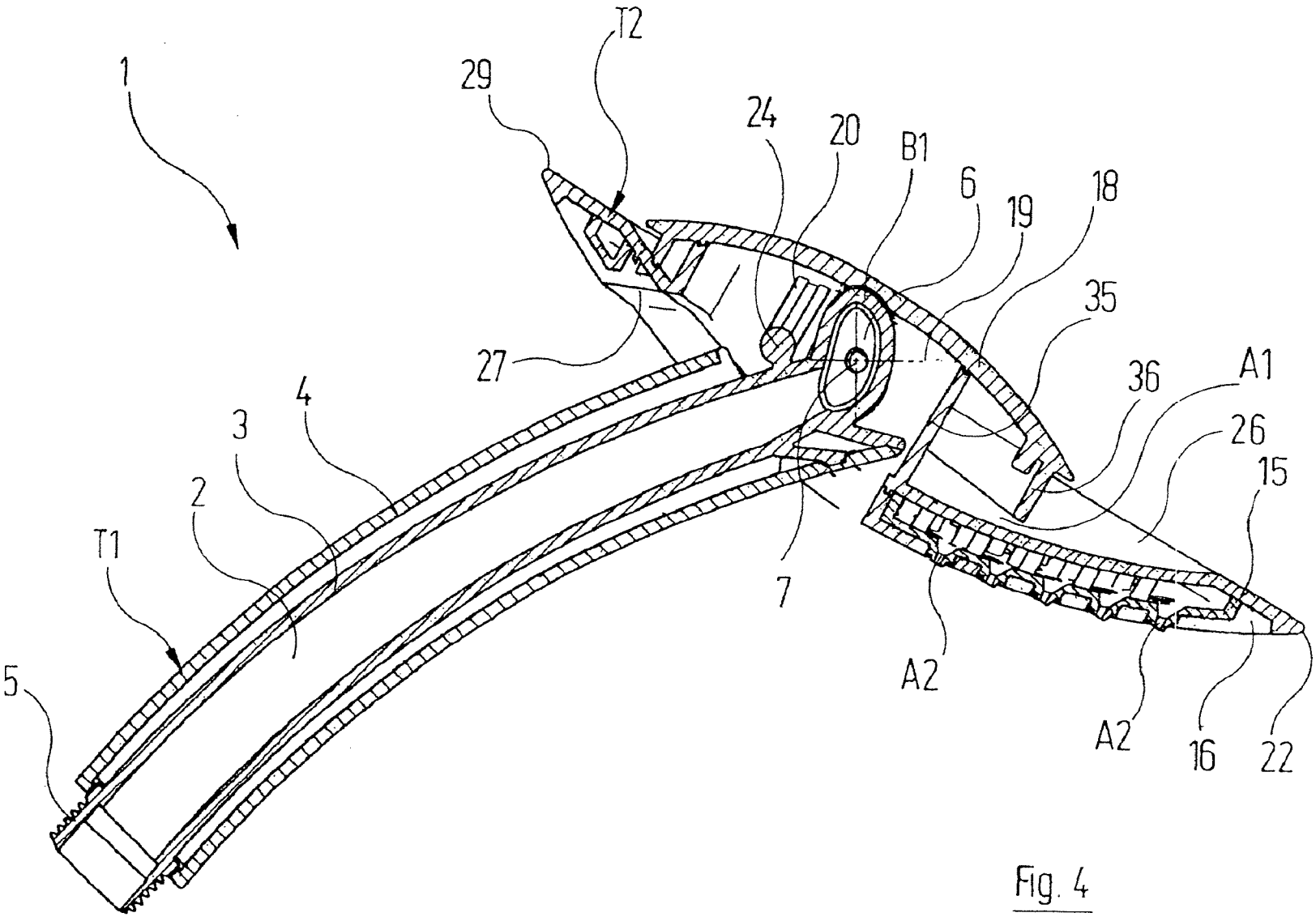
FIG. 4 shows a section, similar to FIG. 3, but in a second mode of operation of the shower head.

Formed on the upper part 15 is a cylindrical collar 35, the axis of which runs parallel to the axis of the upper part 15 itself (FIGS. 3 and 4).

A cap-shaped cover 18 is placed on the collar 35 of the upper part 15 from above and latched to it. A skirt 36, extending downwards from the radially outer border of the cover 18, ends regionally (on the right in FIGS. 3 and 4) at a distance from the dish-shaped upper part 15 and in this way forms a discharge opening A1, via which water can flow from the space lying radially inside the skirt 36 into the space lying radially outside the skirt 36, in a manner still to be described.

In addition, the cover 18 has at its underside an integral supporting part 20 which rests on a pivot 24. The latter is for its part formed on the upper side of the water-guiding pipe 3.

As shown in FIGS. 3 and 4, the second part T2 has a through-opening 27, in which the first part T1 engages from below. The opening 27 is dimensioned such that the second part T2 is pivotable about the pivot 24 to and fro between an upper and a lower pivoted position. In FIG. 3, the second part T2 is shown in the upper pivoted position, in which the overflow edge 22 lies approximately in a horizontal plane. The axis of the outflow dish 21 formed by the second part T2 is in this case approximately vertical. The arrow 28 indicates the direction of the pivoting movement, by which the second part T2 can be moved about the pivot 24 into the lower pivoted position illustrated in FIG. 4. During this pivoting movement, the plane in which the overflow edge 22 lies is inclined relative to the horizontal. In the process, the overflow edge 22 is moved downwards, while the diametrically opposite region 29 of the border of the outflow dish 21 is moved upwards in accordance with arrow 30. The pivoting angle which lies between the two pivoted positions illustrated in FIGS. 3 and 4 is limited in a suitable manner.

The switching valve V is formed by a region B1 of the first part T1 and a region B2 of the second part T2.

The region B1 of the part T1 has in cross-section, as can be seen from FIGS. 3 and 4, approximately the shape of an ellipse not completely closed, the major axis of which is at an acute angle to the vertical. It has two lateral discharge openings 7, of which only one can be seen in FIGS. 3 and 4, whereas both can be seen in FIGS. 5 and 6. These discharge openings 7 are circular openings which lead laterally out of the space 6 which is enclosed is by the region B1 and communicates with the water-guiding channel 2 in the water-guiding pipe 3 of the first part T1. The flow direction through the discharge openings 7 is thus substantially at right angles to the flow direction in the water-guiding channel 2.

One of the two discharge openings 7 is formed in a wall 12 which is inserted in the manner of a cover into a lateral opening 13 of the peripheral wall 11 of the region B1. The other discharge opening 7, the right-hand opening in FIGS. 5 and 6, is situated in a side wall of the region B1 integrally formed on the peripheral wall 11.

Figure 5:
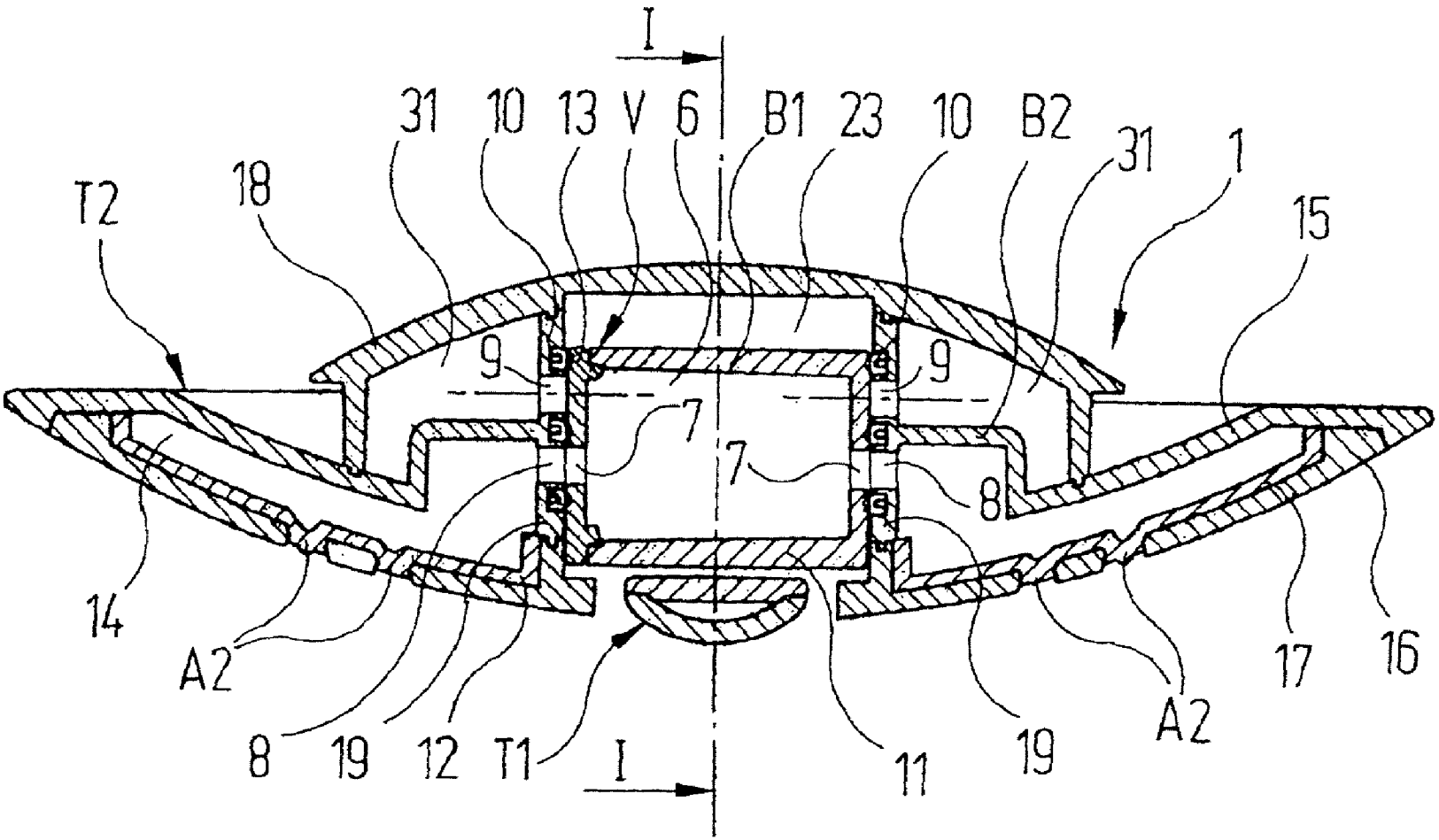
FIG. 5 shows a section along the line A-A of FIG. 2 in the first mode of operation of the shower head.

If the second part T2 of the shower head 1 is situated in the upper pivoted position illustrated in FIGS. 3 and 5, the discharge openings 7 of the region B1 are each in communication with an inlet opening 8 of the region B2 of the second part T2, as shown in FIG. 5. These inlet openings 8 are formed in two connecting members 19 which run parallel to one another and are formed on the lower part 16 of the second part T2, as can be seen in FIGS. 5 and 6. The inlet openings 8 lead into the already-mentioned interior space 14 between the upper part 15 and the lower part 16 of the second part T2, which space communicates with the outlet openings A2. Rubber-elastic sealing means 10 are inserted into recesses of the connecting members 19; they serve to seal the connecting members 19 with respect to the region B1 of the first part T1. They are designed such that the region B1 is displaceable along the inner side of the connecting members 19.

If the second part T2 is situated in the upper pivoted position shown in FIGS. 3 and 5 and water flows in through the water supply channel 2 in the direction of the arrow 25, this water passes into the space 6 within the region B1 and from this through the openings 7 and 8 into the interior space 14 of the outflow dish 21, and finally emerges as a shower jet downwards through the outlet openings A2.

Figure 6:
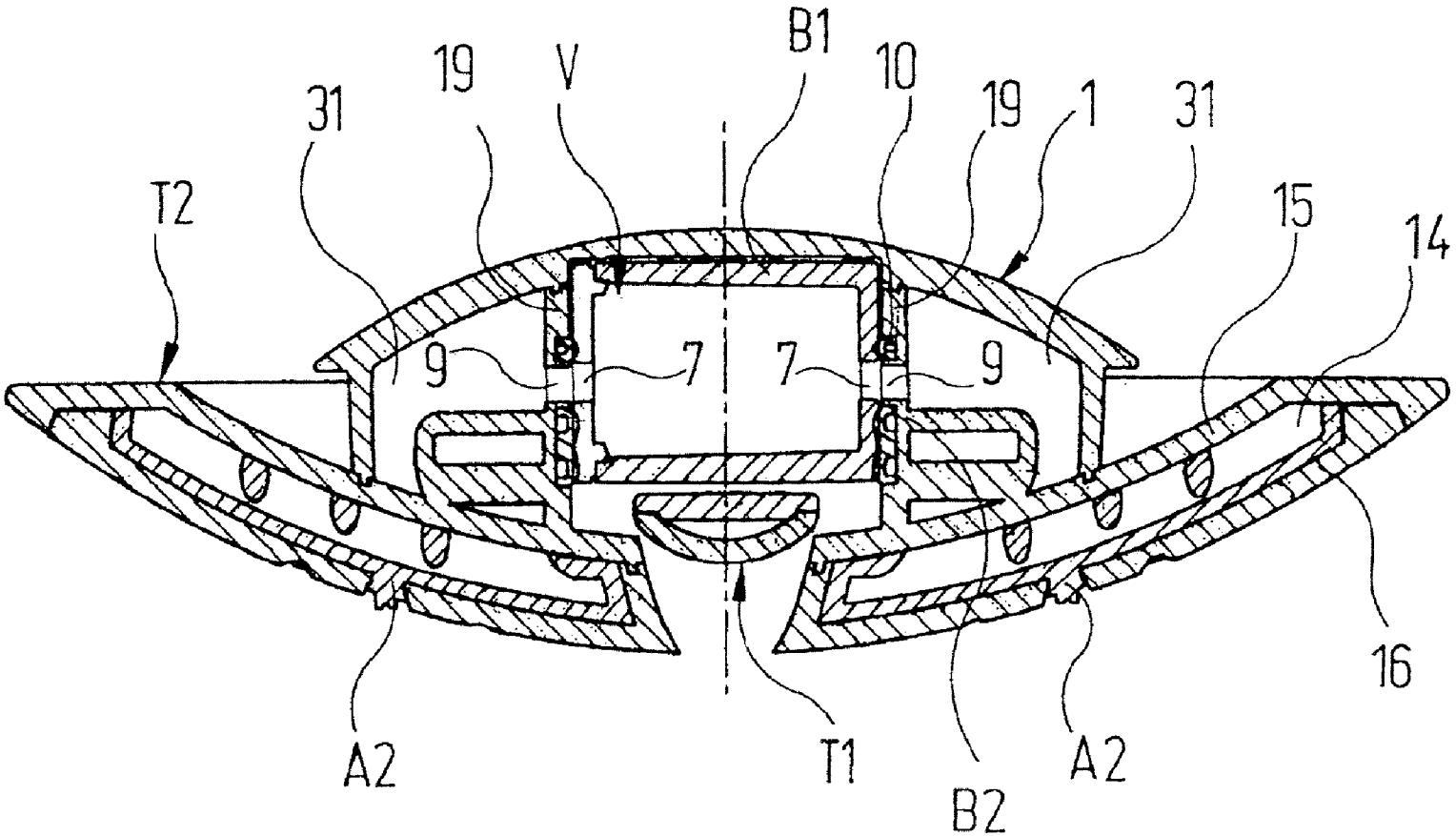
FIG. 6 shows a section, similar to FIG. 5, in the second mode of operation of the shower head.

Above the inlet openings 8, two further inlet openings 9 are formed in the connecting members 19, as can be seen from FIGS. 5 and 6, which further inlet openings are closed by the region B1 of the part T1 in the pivoted position of the shower head 1 illustrated in FIGS. 3 and 5. If the second part T2 is now pivoted about the pivot 24 as mentioned above, the second inlet openings 9 move downwards into the position illustrated in FIG. 6. In this position, the second inlet openings 9 are connected to the discharge openings 7 of the region B1 and the first inlet openings 8 are closed by this region B1.

The second inlet openings 9 in the connecting members 19 are connected to a space 31 which is bounded by the cover 18, the skirt 36 of the latter and the upper part 15. This space leads via the above-mentioned outlet opening A1 into the upwardly open receiving space 26 of the outflow dish 21. If water now flows in through the water-guiding channel 2, this water again passes into the space 6 surrounded by the region B1 of the first part T1. In turn, the water flows laterally through the discharge openings 7, but now through the second inlet openings 9 outwards into the space 31. From there, the water passes through the outlet opening A1 into the receiving space 26 of the outflow dish 21. Since the overflow edge 22 is now displaced downwards and the diametrically opposite edge 29 is now displaced upwards, the water flows out of the receiving space 26 via the overflow edge 22 downwards in a closed curtain.

If the second part T2 is pivoted anticlockwise again into the position shown in FIG. 1, the second inlet openings 9 in the connecting members 19 are closed again by the region B1 of the first part T1 and the discharge openings 7 of the region B1 are connected to the lower inlet openings 8 of the connecting members 19. The water then flows out through the plurality of lower outlet openings A2 again and no longer via the outflow dish 21.

In the above-described exemplary embodiment of a shower head 1, there is only a single, continuous interior space 14 between the upper part 15 and the lower part 16 of the outflow dish 21. This interior space 14 may, however, also be subdivided by partition walls, so that groups of outlet nozzles A2 can be supplied with water by suitably changing the routing of the water, in order to produce different jet forms.

It is again emphasized that the above-described embodiments of the present invention, particularly, any "preferred" embodiments, are possible examples of implementations merely set forth for a clear understanding of the principles of the invention. Many variations and modifications may be made to the above-described embodiments of the invention without substantially departing from the spirit and principles of the invention. All such modifications are intended to be included herein within the spirit of the invention and the scope of protection is only limited by the accompanying claims.

The invention claimed is:

1. A shower head for a shower comprising:

a) a housing-like first part (T1), in which runs a water-guiding channel which communicates, at a first end, with a water inflow opening;

b) a second part (T2), which is connected to the first part (T1) and is formed as an outflow element, a receiving space of which communicates with a second end of the water-guiding channel in at least one mode of operation of the shower head, and an outer border of which, in this mode of operation, forms in one region an overflow edge via which water can flow off;

c) the second part (T2) additionally having a plurality of nozzle-like outlet openings (A2) which communicate with the second end of the water-guiding channel at least in a second mode of operation of the shower head and through which a corresponding plurality of shower jets can then emerge; wherein d) the second part (T2), forming the outflow element, is formed from an upper part and a lower part, between which at least one interior space is situated, which communicates with the second end of the water-guiding channel in the second mode of operation of the shower head; and, e) the nozzle-like outlet openings (A2) being arranged in the lower part.

2. The shower head of claim 1, wherein the interior space of the second part between upper part and lower part is subdivided by at least one partition wall into at least two partial spaces which can be supplied with water independently of one another.

3. The shower head of claim 1, wherein the nozzle-like outlet openings (A2) are formed in an elastic insert which is arranged on the inner side of the lower part.

4. The shower head of claim 1, wherein the second part (T2) is adjustable between at least two positions relative to the first part (T1), one mode of operation of the shower head being associated with each of these positions.

5. The shower head of claim 2, wherein the nozzle-like outlet openings (A2) are formed in an elastic insert which is arranged on the inner side of the lower part.

6. The shower head of claim 5, wherein the second part (T2) is adjustable between at least two positions relative to the first part (T1), one mode of operation of the shower head being associated with each of these positions.

7. The shower head of claim 2, wherein the second part (T2) is adjustable between at least two positions relative to the first part (T1), one mode of operation of the shower head being associated with each of these positions.

8. The shower head of claim 3, wherein the second part (T2) is adjustable between at least two positions relative to the first part (T1), one mode of operation of the shower head being associated with each of these positions.

* * * * *